US006272754B1

(12) United States Patent
Hesprich

(10) Patent No.: US 6,272,754 B1
(45) Date of Patent: Aug. 14, 2001

(54) RETROFIT HANDLE ATTACHMENT FOR SCISSORS

(75) Inventor: Donald N. Hesprich, Huntersville, NC (US)

(73) Assignee: Jameson Corporation, Clover, SC (US)

( * ) Notice: Subject to any disclaimer, the term of this patent is extended or adjusted under 35 U.S.C. 154(b) by 0 days.

(21) Appl. No.: 09/406,550

(22) Filed: Sep. 27, 1999

(51) Int. Cl.[7] ..... B26B 13/20
(52) U.S. Cl. ..... 30/232; 30/341
(58) Field of Search ..... 30/232, 231, 341, 30/340, 291, 298; 16/114 R

(56) References Cited

U.S. PATENT DOCUMENTS

D. 409,064 5/1999 Olix et al. .
D. 409,465 5/1999 Olix et al. .
3,840,990 * 10/1974 Laurenti ..... 30/341
5,720,103 2/1998 West et al. .

OTHER PUBLICATIONS

Heritage Cutlery Inc.; Brochure: "Large Ring Electrician Snip"; 1 page; Published prior to Sep. 27, 1999.

* cited by examiner

*Primary Examiner*—Douglas D. Watts
(74) *Attorney, Agent, or Firm*—Adams, Schwartz & Evans, P.A.

(57) ABSTRACT

A retrofit handle attachment for scissors. The attachment includes a contoured attachment body adapted for being secured to a handle portion of the scissors and held in a palm of a user. The attachment body defines an enlarged surface area for being gripped by the user. Fasteners are provided for securing the attachment body to the handle portion of the scissors, whereby the handle attachment increases the comfort of the scissors in the palm of the user to reduce fatigue and the incidence of repetitive motion injury.

11 Claims, 4 Drawing Sheets

RETROFIT HANDLE ATTACHMENT FOR SCISSORS

TECHNICAL FIELD AND BACKGROUND OF INVENTION

This invention relates to a handle attachment for scissors, such as conventional splicer snips used for cutting wire and cable. The invention is a retrofit item adapted to fit onto the existing handle portion of scissors to facilitate gripping, increase comfort, and reduce the incidence of injury to the user resulting from repeated use.

In recent years, the "human engineering" of useful tools and articles prevalent in the workplace has demanded increased consideration. "Ergonomics", as its called, is an applied science concerned with certain human characteristics that need to be considered when designing and arranging things that we use in order that people and things will interact most effectively and safely. The impact of ergonomics takes years to develop and as such, cannot be studied in brief. Tools and articles which are designed without ergonomic consideration may result in eventual injury to the user.

These injuries are referred to generally as cumulative trauma disorders, repetitive motion injuries, or repetitive stress injuries; terms which will be used interchangeably herein. The injury is caused by a motion or impact where the contact may be small and by itself would do no real damage, but after hundreds or thousands of repetitions affecting the same area of the body over a period of time, the cumulative damage created can be immense. One of the most commonly known cumulative trauma disorder is carpal tunnel syndrome.

Carpal tunnel syndrome is a condition impacting the hand and wrist which has been linked to occupations that require repetitive use of the hands, such as typing. The condition generally results when the median nerve fails to work properly. This is thought to occur because of too much pressure on the nerve as it runs into the wrist through an opening called the "carpal tunnel".

This occurrence is best understood given a brief explanation of some of the anatomy of the wrist. The median nerve runs into the hand to supply sensation to the thumb, index finger, long finger, and half of the ring finger. The nerve also supplies a branch to the muscles of the thumb, the thenar muscles. These muscles help move the thumb and are very important in moving the thumb so that it can touch each of the other fingers. This motion is called opposition.

The carpal tunnel is an opening into the hand that is made up of the bones of the wrist on the bottom and the transverse carpal ligament on the top. Through this opening, the median nerve and the flexor tendons run into the hand. The median nerve lies just under the transverse carpal ligament.

The flexor tendons are important because they allow us to move the fingers and the hand, such as when we grasp objects. The tendons are covered by a material called tensynovium. The tensynovium is very slippery, and allows the tendons to glide against each other as the hand is used to grasp objects. Any condition that causes irritation or inflammation of the tendons can result in swelling and thickening of the tensynovium. As the tensynovium covering all the tendons begins to swell and thicken, pressure begins to increase in the carpel tunnel because the bones and ligaments that make up the tunnel are not able to stretch in response to the swelling. Increased pressure in the carpal tunnel begins to squeeze the median nerve against the transverse carpal ligament because the nerve is the softest structure in the carpal tunnel. Eventually, the pressure reaches a point when the nerve can no longer function normally. This results in pain and numbness in the hand.

One of the first symptoms of carpal tunnel syndrome is numbness in the distribution of the median nerve. This is quickly followed by pain in the same distribution. The pain may also radiate up the arm to the shoulder and sometimes the neck. If the condition is allowed to progress, weakness the thenar muscles can occur. This results in an inability to bring the thumb into opposition with the other fingers, thereby hindering a persons ability to grasp.

Recently, physicians have begun to recognize that activities that involve highly repetitive use of the hands can result in carpal tunnel syndrome, especially if the wrist is bent. When the wrist is bent away from a neutral position (straight), the tendons and tensynovium are drawn across the bones of the wrist or transverse carpal ligament at an angle. This increases the normal pressure and friction that the tensynovium is designed to prevent. Over an extended time, this internal strain is thought to contribute greatly to the development of carpal tunnel syndrome. Additional factors that are thought to contribute to carpal tunnel syndrome are rheumatoid arthritis, previous injuries to the hand or wrist (especially broken bones), a cyst on the tendon, diabetes, and an underactive Thyroid.

Additionally, physicians have been concerned about the effects of repeated high stress loading of the palm. This occurs during routine tasks such as using pliers. Repetitive high stress grasping like this is thought to injure the tendons and tensynovium of the hand.

*Shands' Handbook of Orthopedic Surgery* provides the following description of the anatomy of the soft tissue of the wrist and hand:

> "Where long flexor tendons must pull at an angle, as in the wrist, distal palm (close to the fingers), and digits, they are invested (surrounded) in a double-layered synovial sac or tendon sheath (tensynovium). This delicate membrane facilitates the smooth gliding of the tendon. To prevent the flexor tendons from bow-stringing in the distal palm and fingers, the tendons and their synovial sheaths are incased in ligamentous tunnels. In these narrow passages, fibrous adhesions (bumps) of the tendon, sheath, and tunnel wall may immobilize the tendon and destroy it's function."

With the tendons responsible for the flexing of the fingers running through the palm in these ligamentous tunnels, it follows how the tensynovium in them becomes irritated by repeated applications of high pressure or a sudden impact. There is little protection for these tendons and tunnel. Sudden impacts to the palm, like those generated when using the palm as a hammer to, for example, drive a screwdriver in to wedge a splice case open, can cause the tunnels to swell and pinch against the tendon. Continued use of the hand exacerbates the swelling. The next event will generally cause significant pain and associated dysfunction in the fingers as well as the wrist.

In view of the above considerations, it became apparent to the Applicant that scissors used by splicers, called "snips", needed to be evaluated with respect to carpal tunnel syndrome and other repetitive motion injuries. The dangers of being cut by a sharp snip are apparent, but what about the wear and tear on the palm of the hand after splicing 2500 or 3000 pair cable.

With the typical snip, a relatively small thumb ring is placed against the mid-portion of the palm while the middle or ring finger is used to open and close the snip. This small thumb ring, which has an effective pressure area of less than ¼ square inch, is repeatedly forced into the palm with each cut. On difficult cuts, the thumb ring has a tendency to slide up the palm into the distal region. To maintain control of the snip and complete the cut, the wrist must be rotated out of the neutral position. This opens the door to carpal tunnel syndrome resulting from cumulative stress.

Moreover, the thumb ring typically rests directly over the tendon and tunnel of the finger responsible for the opposing force to make the cuts. In this case, any swelling in the tensynovium is compressed by the thumb ring thereby magnifying the resulting pressure on the tendon.

To combat this problem, the Applicant sought to develop a device that would provide an effective reduction of the stresses contributing to this and other cumulative trauma disorders. A program was launched with three main goals in mind:

1. Design a device to effectively reduce the stress and strain placed on the palm (and resultant tendons and tunnels).
2. Design a device to provide increased stability in the hand thus eliminating the need for bending of the wrist.
3. Design a device so that it could be retrofitted to any brand of snip, thus making it accessible to all users.

The primary objective was to reduce the pressure on the tendons and tunnels. This is accomplished in the present invention by increasing the area of contact in the palm. By creating a handle attachment that both widens and lengthens the contact of the snip in the palm as well as contouring the attachment to fit the arch of the palm, this goal was achieved. Additionally, Applicant determined that by lengthening the handle of the snip through the present attachment, the little finger could be employed to stabilize the snip in the hand, thus eliminating the need to bend the wrist during cutting. Accommodation for the little finger was made by slightly raising the lengthened portion of the handle attachment.

The first prototypes of the invention achieved the targeted objectives and more. The pressure area was increased to over 1¼ square inches. This results in more than an 80% decrease in the pressure on the palm. The new stability enabled the user to make repeated cuts without fear of the snip shifting in their palm. The amount of effort to make the cut was also reduced, thus producing less fatigue.

Dean Chappell, OHST Safely Director-Eastern zone GTE Service Corporation, states it clearly: "The hand can create more force when using a full handgrip. A pinch grip should only be used for precision work or when handling small objects." To satisfy the occasional need for a pinch grip. Applicant formed the invention with a thumb ring opening. As a final design step, the invention was injection molded with a textured outer surface to further enhance its grip, even in the most adverse conditions, and was made in a bright red color to make the snip/handle attachment easier to locate if dropped.

SUMMARY OF THE INVENTION

Therefore, it is an object of the invention to provide a handle attachment for scissors which reduces the incidence of repetitive motion or stress injuries, cumulative trauma disorders, and on-the-job fatigue.

It is another object of the invention to provide a handle attachment which increases the stability of the scissors within the hand thus eliminating the need to bend the wrist when making a cut.

It is another object of the invention to provide a handle attachment which is capable of being retrofitted to most brands of splicer snips.

It is another object of the invention to provide a handle attachment which is contoured to fit comfortably within the palm of the user.

It is another object of the invention to provide a handle attachment which is injection molded from a lightweight polymer.

It is another object of the invention to provide a handle attachment which is relatively inexpensive to manufacture.

These and other objects of the present invention are achieved in the preferred embodiments disclosed below by providing a retrofit handle attachment for scissors. The attachment includes a contoured attachment body adapted for being secured to a handle portion of the scissors and held in a palm of a user. The attachment body defines an enlarged surface area for being gripped by the user. Means are provided for securing the attachment body to the handle portion of the scissors, whereby the handle attachment increases the comfort of the scissors in the palm of the user to reduce fatigue and the incidence of repetitive motion injury.

According to another preferred embodiment of the invention, the attachment body includes first and second overlying halves having respective inside and outside major surfaces. The inside major surfaces define a space between each other adapted for accommodating the handle portion of the scissors.

According to yet another preferred embodiment of the invention, the outside major surfaces of the first and second halves are textured to increase the grip of the attachment.

According to yet another preferred embodiment of the invention, the attachment body includes a finger ring opening adapted for being aligned with a finger ring opening of the scissors.

According to yet another preferred embodiment of the invention, the attachment body includes a contoured palm-engaging extension shaped for being engaged by the little finger of the user.

According to yet another preferred embodiment of the invention, the attachment body includes a relatively wide, palm-engaging perimeter wall having a dimension of between 0.2 and 0.5 inches.

According to yet another preferred embodiment of the invention, the attachment body is formed of a molded polymer.

According to yet another preferred embodiment of the invention, the attachment body is formed of metal.

In another embodiment, a retrofit handle attachment for scissors a contoured attachment body formed of a polymer and adapted for being secured to a handle portion of the scissors and held in a palm of a user. The attachment body defines an enlarged surface area for being gripped by the user and includes first and second overlying halves having respective inside and outside major surfaces. The inside major surfaces define a space between each other adapted for accommodating the handle portion of the scissors. Means are provided for securing the attachment body to the handle portion of the scissors, whereby the handle attachment increases the comfort of the scissors in the palm of the user to reduce fatigue and the incidence of repetitive motion injury.

According to another preferred embodiment of the invention, the first and second halves of the attachment body are connected together by means of one or more removable fasteners.

According to yet another preferred embodiment of the invention, the fasteners are externally-threaded screws.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
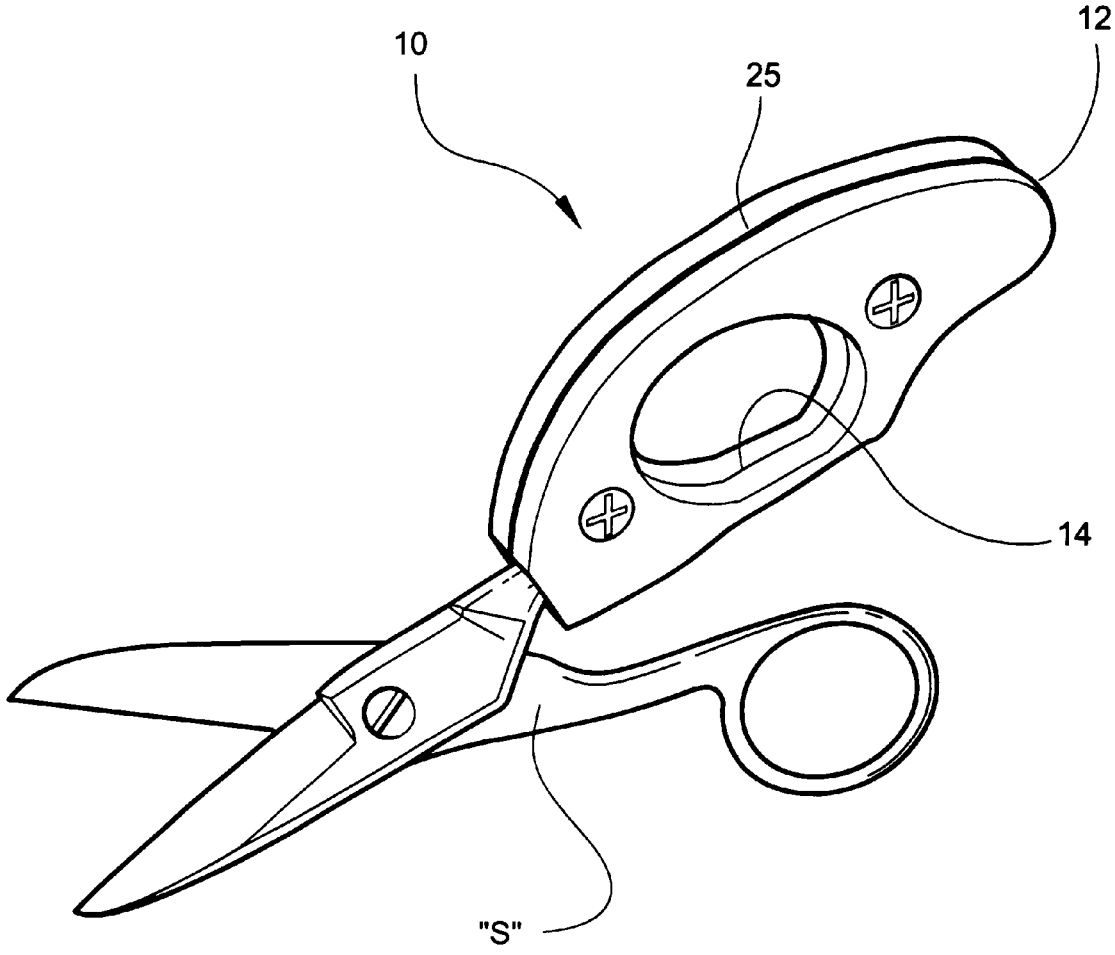
FIG. 1 is a perspective view of the retrofit handle attachment in an assembled condition on the handle portion of the scissors.

Referring now specifically to the drawings, a retrofit handle attachment according to the present invention is illustrated in FIG. 1 and shown generally at reference numeral 10. The handle attachment 10 is especially applicable for use with scissors "S" used by splicers to cut wire and cable. The attachment 10 may have further application to other hand-held tools and implements, such as pliers.

Figure 2:
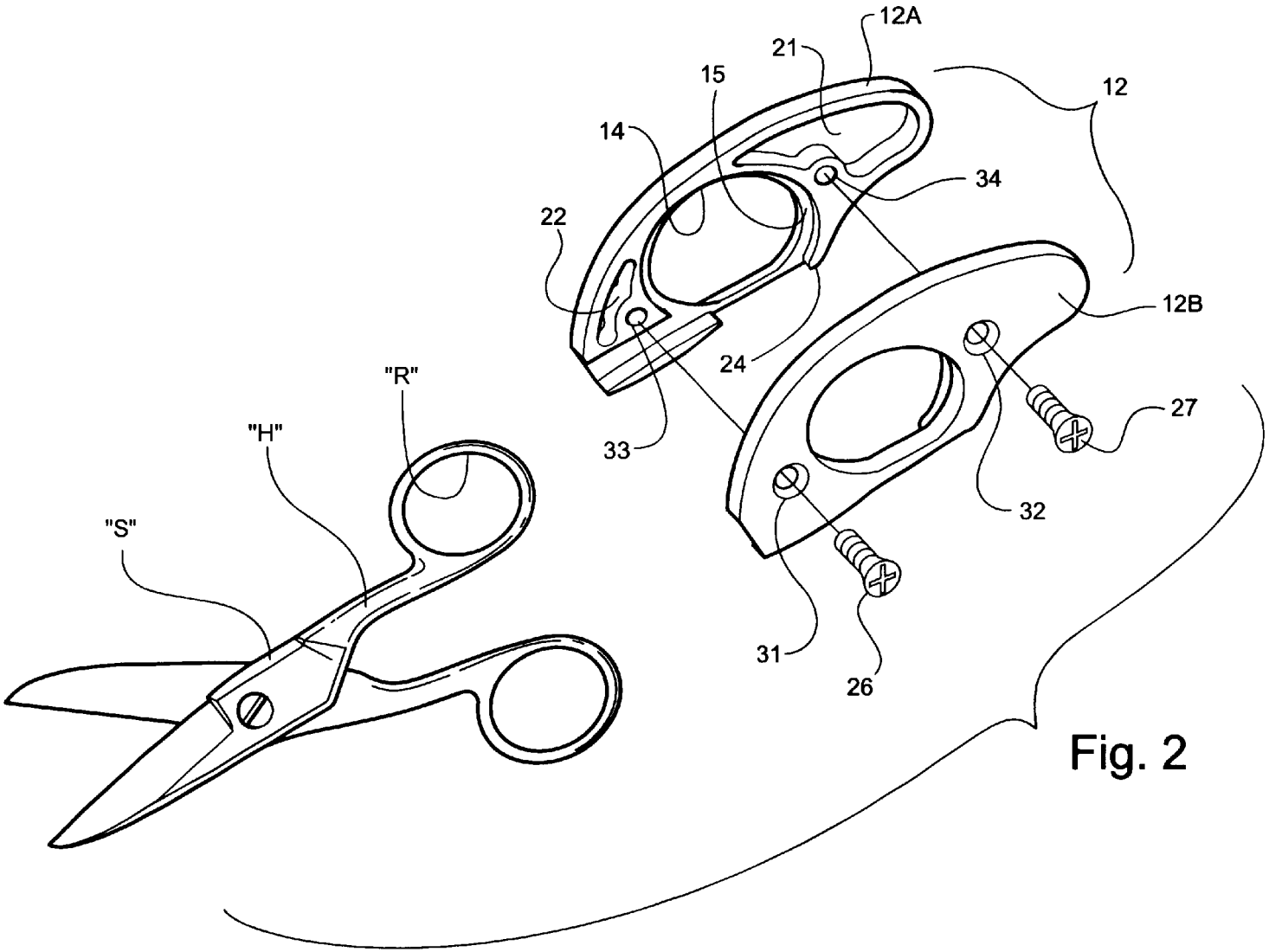
FIG. 2 is an exploded view of the retrofit handle attachment with its halves separated and spaced apart from the scissors.
Figure 3:
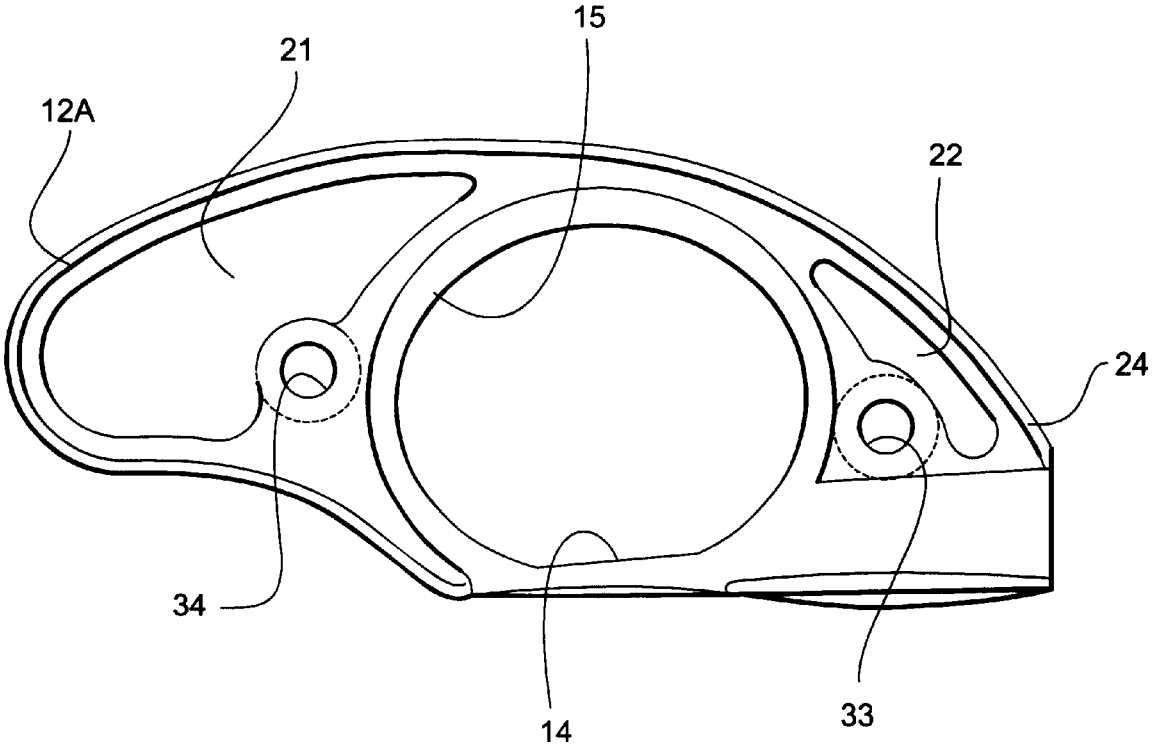
FIG. 3 is a plan view showing an inside major surface of one of the attachment halves.

Referring to FIGS. 2 and 3, the handle attachment 10 is formed of an attachment body 12 contoured to fit comfortably within the hand of the user. The attachment body 12 includes first and second opposing halves 12A and 12B which fit together on either side of a finger ring "R" formed with the handle portion of the scissors "S". The halves 12A and 12B are preferably formed of an injection molded polymer, such as ABS, or metal. Each half 12A, 12B has a center opening 14 and a recessed shoulder 15 formed with its inside major surface and extending around the perimeter of the center opening 14 for receiving the finger ring "R" of the scissors "S". A further recess 18 extends outwardly from the recessed shoulder 15 to an end of the half 12A, and cooperates with an identical recess formed with the opposing half 12B to form a bed for receiving the shank "H" of the scissors. Cavities 21 and 22 are preferably formed with each half 12A and 12B to reduce the overall weight and manufacturing cost of the handle attachment 10.

According to one embodiment, a perimeter lip 24 is formed around the half 12A and mates with a corresponding groove (not shown) formed around the perimeter of the half 12B upon assembly of the handle attachment 10 on the scissors "S". Once assembled, the halves 12A and 12B of the attachment body 12 cooperate to form a relatively wide perimeter wall 25 (See FIG. 1) a dimension of between 0.3 and 0.6 inches, and defining an enlarged surface area for engaging the palm of the user when making a cut. The wide perimeter wall 25 increases the pressure area on the palm, thereby providing increased comfort to the user and reducing the incidence of repetitive motion injury.

Threaded screws 26 and 27 are inserted through complementary-threaded openings 31, 32, 33, and 34 formed in the halves 12A, 12B to secure the handle attachment 10 to the scissors "S". The halves 12A, 12B may alternatively be attached using any suitable adhesive or, in the case of metal halves, by welding. With the exception of the perimeter lip and groove, the halves 12A and 12B are preferably identical. In another embodiment (not shown), the attachment body includes only one of the halves, and a holding plate for securing the handle attachment to the scissors.

Figure 4:
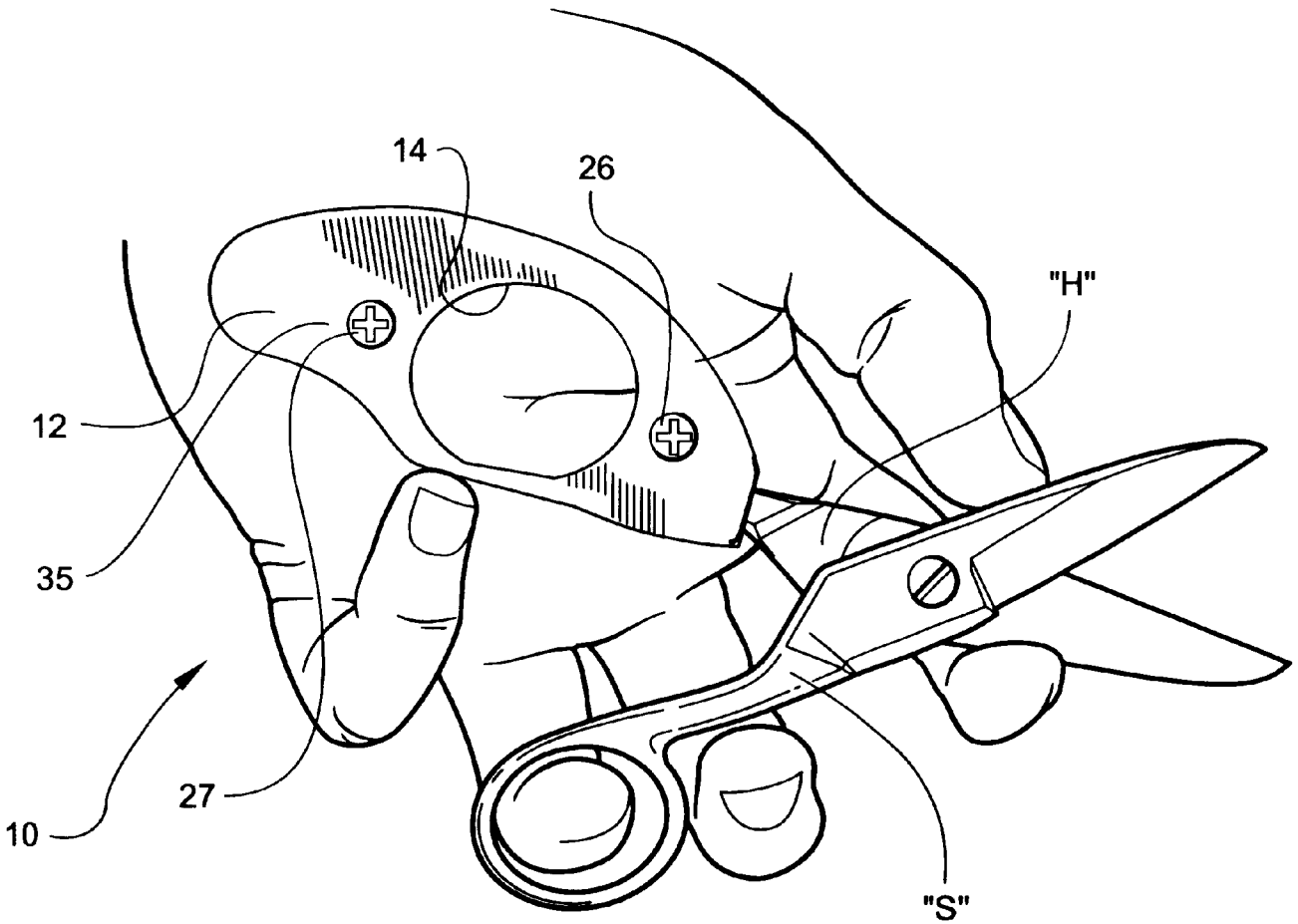
FIG. 4 is a perspective view of the scissors and handle attachment positioned within the palm of a user.

As best shown in FIG. 4, the attachment body 12 preferably has a contoured palm-engaging extension 35 which is shaped for being engaged by the little finger of the user when holding and using the scissors "S". This area 35 facilitates proper gripping and provides increased comfort to the hand. In addition, the outside major surfaces of the halves 12A, 12B may have an integrally molded rough texture to further promote gripping.

A retrofit handle attachment for scissors is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A retrofit handle attachment for scissors, comprising (a) a contoured attachment body for being secured to a handle portion of the scissors and held in a palm of a user, said attachment body defining an enlarged surface area for being gripped by the user, and a contoured palm-engaging extension adapted for extending outwardly beyond the handle portion of the scissors in a direction away from a blade end of the scissors; and (b) means for securing said attachment body to the handle portion of the scissors, whereby said handle attachment increases the comfort of the scissors in the palm of the user to reduce fatigue and the incidence of repetitive motion injury.

2. A retrofit handle attachment according to claim 1, wherein said attachment body comprises first and second overlying halves having respective inside and outside major surfaces, the inside major surfaces defining a space therebetween adapted for accommodating the handle portion of the scissors.

3. A retrofit handle attachment according to claim 2, wherein the outside major surfaces of said first and second halves are textured to increase the grip of said attachment.

4. A retrofit handle attachment according to claim 1, wherein said attachment body includes a finger ring opening adapted for being aligned with a finger ring opening of the scissors.

5. A retrofit handle attachment according to claim 1, wherein said attachment body includes a relatively wide, palm-engaging perimeter wall having a dimension of between 0.2 and 0.5 inches.

6. A retrofit handle attachment according to claim 1, wherein said attachment body is formed of a molded polymer.

7. A retrofit handle attachment according to claim 1, wherein said attachment body is formed of metal.

8. A retrofit handle attachment for scissors, comprising:

(a) a contoured attachment body formed of a polymer and adapted for being secured to a handle portion of the scissors and held in a palm of a user, said attachment body defining an enlarged surface area for being gripped by the user and comprising first and second overlying halves having respective inside and outside major surfaces, the inside major surfaces defining a space therebetween adapted for accommodating the handle portion of the scissors, and said attachment body further defining a contoured palm-engaging extension adapted for extending outwardly beyond the handle portion of the scissors in a direction away from a blade end of the scissors; and (b) means for securing said attachment body to the handle portion of the scissors, whereby said handle attachment increases the comfort of the scissors in the palm of the user to reduce fatigue and the incidence of repetitive motion injury.

9. A retrofit handle attachment according to claim 8, wherein the first and second halves of said attachment body are connected together by means of one or more removable fasteners.

10. A retrofit handle attachment according to claim 9, wherein said fasteners comprise externally-threaded screws.

11. In combination with a pair of scissors, a retrofit handle attachment comprising:

(a) a contoured attachment body secured to a handle portion of the scissors and held in a palm of a user, said attachment body defining an enlarged surface area for being gripped by the user, and a contoured palm-engaging extension extending outwardly beyond the handle portion of the scissors in a direction away from a blade end of the scissors; and (b) means for securing said attachment body to the handle portion of the scissors, whereby said handle attachment increases the comfort of the scissors in the palm of the user to reduce fatigue and the incidence of repetitive motion injury.

* * * * *